US009000920B2

(12) United States Patent
Fawcett et al.

(10) Patent No.: US 9,000,920 B2
(45) Date of Patent: Apr. 7, 2015

(54) REDUCED COST MERCHANDISE DISPLAY SECURITY DEVICE INCLUDING MERCHANDISE POWER SUPPLY

(71) Applicant: InVue Security Products Inc., Charlotte, NC (US)

(72) Inventors: Christopher J. Fawcett, Charlotte, NC (US); Jeffrey A. Grant, Charlotte, NC (US); Larry T. McKinney, Huntersville, NC (US)

(73) Assignee: InVue Security Products Inc., Charlotte, NC (US)

( * ) Notice: Subject to any disclaimer, the term of this patent is extended or adjusted under 35 U.S.C. 154(b) by 0 days.

(21) Appl. No.: 13/892,626

(22) Filed: May 13, 2013

(65) Prior Publication Data

US 2013/0307692 A1 Nov. 21, 2013

Related U.S. Application Data

(60) Provisional application No. 61/647,067, filed on May 15, 2012.

(51) Int. Cl.
*G08B 13/14* (2006.01)

(52) U.S. Cl.
CPC ..... *G08B 13/1445* (2013.01); *Y10S 439/917* (2013.01)

(58) Field of Classification Search
USPC ..... 340/568.1, 568.2, 568.3, 568.4, 568.8, 340/686.1, 686.6, 571, 540; 439/505, 917
See application file for complete search history.

(56) References Cited

U.S. PATENT DOCUMENTS

| | | | | |
|---|---|---|---|---|
| 5,543,782 | A * | 8/1996 | Rothbaum et al. | 340/568.2 |
| 6,799,994 | B2 | 10/2004 | Burke | |
| 7,327,276 | B1 | 2/2008 | Deconinck et al. | |
| 7,710,266 | B2 | 5/2010 | Belden, Jr. et al. | |
| 7,714,722 | B2 * | 5/2010 | Marszalek et al. | 340/568.2 |
| 2003/0159949 | A1 | 8/2003 | Gresset | |
| 2005/0073413 | A1 | 4/2005 | Sedon et al. | |
| 2008/0168806 | A1 | 7/2008 | Belden et al. | |
| 2008/0169923 | A1 | 7/2008 | Belden et al. | |
| 2012/0019383 | A1 | 1/2012 | Fawcett et al. | |
| 2012/0120571 | A1 | 5/2012 | Bisesti et al. | |
| 2013/0194096 | A1 * | 8/2013 | Belden et al. | 340/568.4 |

OTHER PUBLICATIONS

"Notification of Transmittal of International Search Report and Written Opinion of the International Searching Authority, or the Declaration" in counterpart International Patent Application No. PCT/US2013/040868; mailed Aug. 24, 2013; 11 pages.

* cited by examiner

*Primary Examiner* — Anh V La
(74) *Attorney, Agent, or Firm* — InVue Security Products

(57) ABSTRACT

A merchandise display security device for displaying and protecting an article of merchandise is provided. For example, the security device comprises an alarm unit and a first connector electrically coupled to the alarm unit and configured to releasably engage the article of merchandise. The security device further comprises a second connector electrically coupled to the alarm unit. The second connector is configured to releasably engage an original equipment manufacturer (OEM) power supply cable such that the alarm unit is disposed between a source of electric power and the article of merchandise, and the power supply cable is configured to provide power to both the alarm unit and the article of merchandise. The alarm unit is configured to at least one of activate an alarm in the event that the first connector is removed from the article of merchandise or the second connector is removed from the power supply cable.

19 Claims, 2 Drawing Sheets

REDUCED COST MERCHANDISE DISPLAY SECURITY DEVICE INCLUDING MERCHANDISE POWER SUPPLY

CROSS REFERENCE To RELATED APPLICATION

This non-provisional application claims the benefit of U.S. Provisional Application No. 61/647,067 filed on May 15, 2012, the disclosure of which is incorporated herein by reference in its entirety.

FIELD OF THE INVENTION

Embodiments of the present invention relate generally to merchandise display security systems for displaying and protecting an article of merchandise from theft.

BACKGROUND OF THE INVENTION

Retailers routinely display relatively small, expensive, handheld electronic merchandise, such as mobile (e.g. cellular) telephones, iPods, game consoles, personal data assistants (PDAs), and the like, for customers to examine before making a purchase. Retailers often desire the handheld electronic merchandise to be powered as well so that a potential purchaser can test the operation and functions of the merchandise. At the same time, the retailer does not want the article of merchandise to be stolen or removed from the display area by an unauthorized person. Accordingly, the article of merchandise being displayed is attached to a merchandise display security device that monitors and protects the article of merchandise from removal or theft. Such a merchandise display security device typically includes a sensor housing to which the article of merchandise is attached that houses a sensor for monitoring whether the article of merchandise remains attached to the sensor housing. In the event that the article of merchandise is detached from the sensor housing, an audible or visible alarm is activated to alert store personnel to the situation.

Oftentimes it is desirable for a retailer to provide power to the merchandise for facilitating use of the device on display as well as charging. For example, a power adaptor cord may be used to power the handheld electronic merchandise, or alternatively, to charge an internal battery that powers the article of merchandise in the absence of an external power source (including an internal power source of the merchandise display security device). Furthermore, the merchandise may be physically secured to the display with a tether. The tether may not only provide physical security, but may also serve to provide power to the sensor and the displayed merchandise. However, these displays oftentimes require specialized tethers and adapters that are hardwired to the sensor.

Accordingly, there exists a need for a merchandise display security system for displaying and protecting a powered article of merchandise from theft. There exists a further need for a merchandise display security device that includes a more cost efficient and less complicated means for providing power to the sensor and/or article of merchandise.

SUMMARY OF THE INVENTION

According to embodiments of the present invention, a merchandise display security device for an article of merchandise is provided. The merchandise display security device comprises an alarm unit and a first connector electrically coupled to the alarm unit and configured to releasably engage the article of merchandise. The merchandise display security device further comprises a second connector electrically coupled to the alarm unit. The second connector is configured to releasably engage an original equipment manufacturer (OEM) power supply cable such that the alarm unit is disposed between a source of electric power and the article of merchandise. The OEM power supply cable is configured to provide power to both the alarm unit and the article of merchandise. Thus, both the alarm unit and the article of merchandise are capable of operating via power provided by the OEM power supply cable. In one embodiment, the first and second connectors are the same type. For example, both the first and second connectors may be micro-USB connectors. As such, the OEM power supply cable is interchangeable with the alarm unit and the article of merchandise, thereby providing a low cost and less complicated system for securing an article of merchandise. Should the alarm unit need to be replaced or repaired, the alarm unit may be decoupled via the first and second connectors for ready replacement or repair. The alarm unit is configured to at least one of activate an alarm in the event that the first connector is removed from the article of merchandise or activate an alarm in the event that the second connector is removed from the OEM power supply cable.

In another embodiment, a method for securing an article of merchandise from theft is provided. The method includes providing an alarm unit comprising a first connector and a second connector each electrically coupled to the alarm unit, the first and second connectors being the same type. The method further includes coupling the article of merchandise to the first connector and coupling the second connector to an OEM power supply cable such that the alarm unit is disposed between a source of electric power and the article of merchandise. The OEM power supply cable is configured to provide power to both the alarm unit and the article of merchandise. In addition, the alarm unit is configured to at least one of activate an alarm in the event that the first connector is removed from the article of merchandise or activate an alarm in the event that the second connector is removed from the OEM power supply cable.

DETAILED DESCRIPTION OF EXEMPLARY EMBODIMENTS

Figure 1:
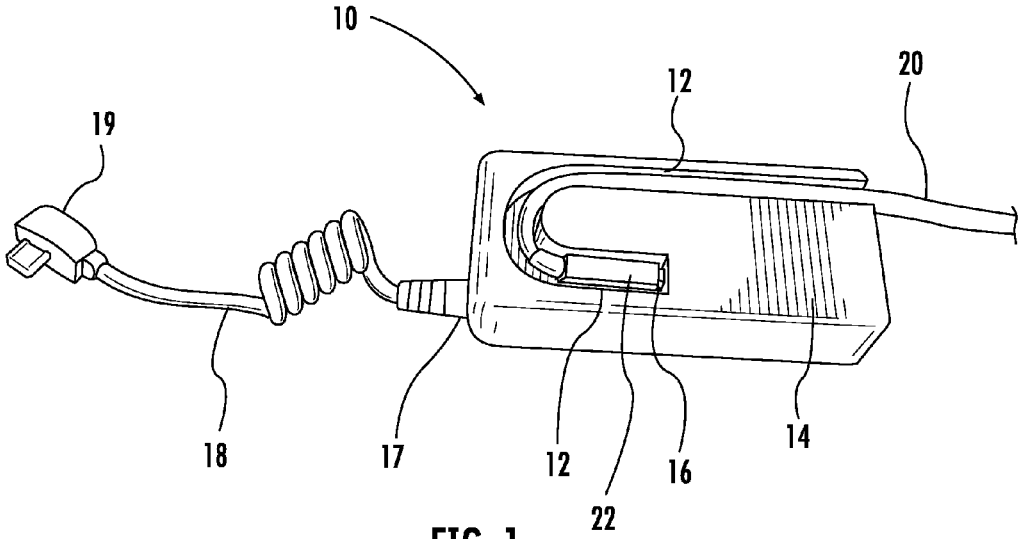
FIG. 1 is a perspective view of a of a merchandise security device according to one embodiment of the invention.

Referring now to the accompanying drawing figures wherein like reference numerals denote like elements throughout the various views, one or more embodiments of a merchandise display security system for displaying and protecting an article of merchandise from theft are shown. More particularly, each embodiment is a merchandise display security device 10, 30 for monitoring whether an article of merchandise, indicated generally by reference character M, remains attached to the security device, and for activating an audible or visible alarm in the event that the article of merchandise is separated from the security device. Embodiments of the present invention are equally applicable to any merchandise display stand, module, pedestal or the like that permits a potential purchaser to examine and operate an article of merchandise in a powered state, regardless of whether the article of merchandise is attached to the display stand or whether the display stand includes an alarm. In some embodiments, the merchandise display security device 10, 30 may be configured to be removably supported on a base. Thus, a customer may remove the merchandise display security device 10, 30 from the base for examination and placed on the base after use. The base may include a base portion and an optional pedestal portion extending upwardly from the base portion. The article of merchandise M may be any number of electronic devices, such as a mobile (e.g. cellular) telephone, iPod, game console, personal data assistant (PDA), tablet, portable computer, and the like. The article of merchandise M is attached to the merchandise display security device 10 in a manner so as to allow customers to examine and operate the merchandise before making a decision to purchase.

As explained in greater detail below, embodiments of the present invention are generally directed to reduced cost merchandise security devices, namely an alarm unit, for protecting merchandise, such as cellular telephones, on display for sale in retail stores. The alarm unit may utilize a power supply cable for the merchandise as the power cable and tether of the alarm unit. As a result, the alarm unit reduces manufacturing and material costs and reduces the complexity of installation and use of the merchandise security device.

FIG. 1 shows a first embodiment of a merchandise security device, namely an alarm unit, 10 according to the invention. In this embodiment, the alarm unit 10 has a body that is generally rectangular and has a recess 12 formed in an attachment side 14 thereof for receiving the free end of a power cable 20, such as an original equipment manufacturer (OEM) power supply cable. However, it is understood that the alarm unit 10 may be any desired shape in other embodiments. In addition, although the recess 12 is shown as being J-shaped, it is understood that the recess may be any desired shape for receiving at a portion of the power supply cable 20 therein, as well as resisting the removal of the power supply cable from the merchandise display security device. An "OEM" power supply cable as used herein refers to a power supply cable that is typically supplied with the article of merchandise by the manufacturer or is an otherwise off-the-shelf power supply cable designed by the manufacturer for use with a particular article of merchandise for providing power. Thus, the OEM power supply cable has a connector that is compatible with an input port on the article of merchandise for providing power thereto.

The free end of the power supply cable 20 has a connector 22 that is configured to be received within the recess 12 and releasably engage a connector 16 on the attachment side 14 of the alarm unit 10. As shown in FIG. 1, the connector 22 of the power supply cable 20 may be any standard or customized connector, such as a standard male micro-USB plug that electrically engages a corresponding connector disposed within the recess 12, such as a female micro-USB jack 16. Alternatively, the power supply cable 20 may be a universal micro-USB power supply cable. Regardless, the connector 22 of the power cable 20 is configured to connect to the connector 16 of the alarm unit 10 within the recess 12 so that once the article of merchandise (e.g. cellular telephone) M is attached to the attachment side 14 of the alarm unit, connector 22 cannot be detached and is otherwise inaccessible to a customer.

The power supply cable 20 is electrically coupled to the alarm unit 10 and the alarm unit in turn provides power to the merchandise M through a power adapter cable 18 that is hard-wired to a power output port 17 of the alarm unit. As used herein, the term "power adapter cable" is intended to include any cable, adapter (also commonly referred to as a "pigtail") or cord containing one or more conductors for providing electrical power to a handheld electronic article of merchandise, for example a mobile (cellular) telephone. The power adapter cable 18 may be provided with a variety of different connectors 19 at the free end thereof to accommodate the various types of power input jacks (e.g. cellular telephone power input jacks) provided on different articles of merchandise M. For example, the connector 19 may be a male micro-USB connector. In addition to providing electrical power to the alarm unit 10 and to the merchandise M, the power supply cable 20 may serve as a mechanical tether holding the alarm unit and the merchandise to a secure display fixture. The alarm unit 10 is configured to activate an alarm in the event the power supply cable 20 is severed, and/or in the event the power adapter cable 18 is severed or removed (unplugged). An internal power source (e.g., a battery) may provide power to activate the alarm in the event that the power supply cable 20 is severed. In one embodiment, the internal power source is a rechargeable battery that is recharged by power supplied by the power supply cable 20.

Figure 2:
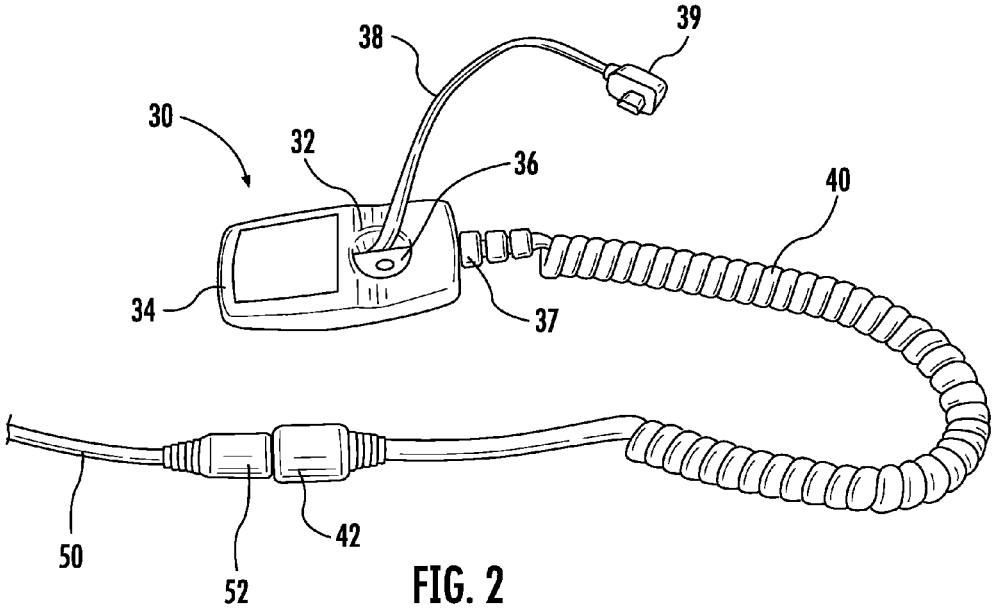
FIG. 2 is a perspective view of a merchandise security device according to another embodiment of the invention.

FIG. 2 shows a second embodiment of a merchandise security device, namely an alarm unit 30, according to the invention. In this embodiment, the alarm unit 30 is generally rectangular and has a recess 32 formed in an attachment side 34 thereof for receiving an end of a power adapter cable 38 at a power output port 36. As noted above, the alarm unit 30 may be any desired shape and, thus, the illustrated embodiment should not be considered limiting. In one embodiment, the power adapter cable 38 comprises a first connector 39 at a first end thereof for engaging a power input port 60 on the article of merchandise M and a second connector at a second end thereof for releasably engaging the power output port 36 of the alarm unit. An extensible (e.g., helical coil) lanyard 40 may be hard-wired to the alarm unit 30 at a power input port 37 and extends from an end thereof terminating in a power input port, or connector, 42. As shown, the connector 42 of the lanyard 40 may be a standard female micro-USB jack that is configured to receive a corresponding standard male micro-USB plug or connector 52 on the free end of an OEM power supply cable, or alternatively, a universal power supply cable 50. Thus, the power supply cable 50 is electrically coupled to the lanyard 40 rather than being directly attached to the alarm unit 30. The plug 52 of the power supply cable 50 is configured to engage the connector 42 of the lanyard 40 at a location that is inaccessible to customers of the retail store so that the power supply cable cannot be inadvertently, or maliciously, removed (unplugged) from the lanyard. For example, the coupling between connector 42 and plug 52 may be located below a display surface or within a display stand so as to be inaccessible.

Use of the second embodiment is advantageous for installation in retail stores in which power "brown-outs" are likely. In the event of a power brown-out, alarms of merchandise security devices 10 according to the first embodiment may be activated, which can be very annoying for customers. The alarms of merchandise security devices 30 according to the second embodiment, however, are not activated when electrical power from the power supply cable 50 is interrupted. Instead, the alarm of the second embodiment of the merchandise security device 30 is activated only if power to the alarm unit 30 and/or the merchandise M is interrupted beyond the connectors 52, 42. In particular, the alarm may be activated in the event that connector 42 of the lanyard 40 is removed (unplugged) from the plug 52 of the power supply cable 50, the lanyard 40 is severed, and/or the power adapter cable 38 is severed or removed (unplugged) from the merchandise M.

Figure 3:
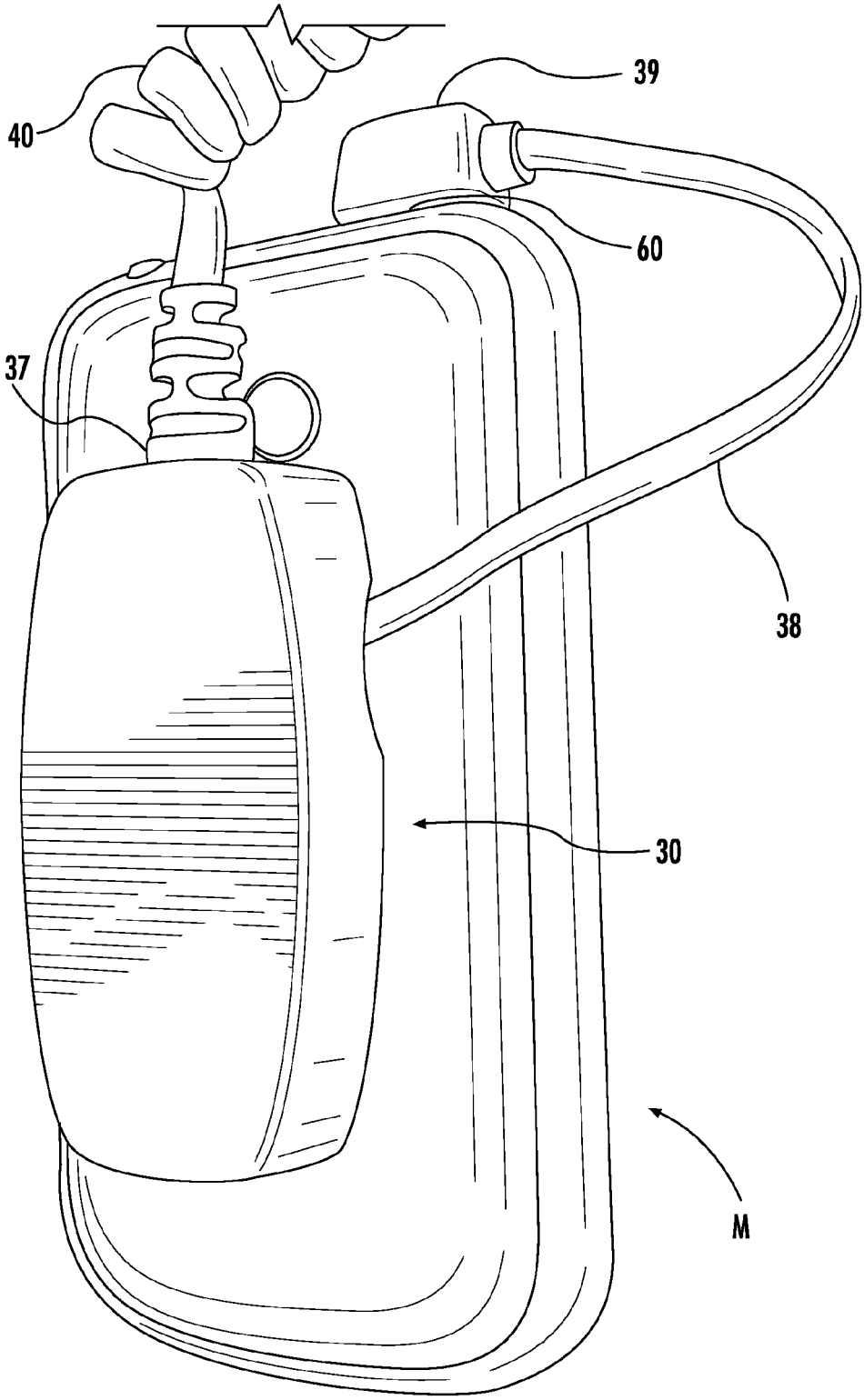
FIG. 3 is a perspective view of the merchandise security device of FIG. 2 shown attached to an article of merchandise adapted for display in a retail store to power and protect the article against theft.

FIG. 3 shows the second embodiment of the merchandise security device 30 of FIG. 2 attached to an article of merchandise M, such as a cellular telephone. The article of merchandise M may be attached to the attachment side 34 of the alarm unit 30 by means of a relatively thin layer of a pressure sensitive adhesive (PSA). The end of the power adapter cable 38 is disposed within the recess 32 of the alarm unit 30 between the attachment side 34 and the merchandise M so that the connector at the end of the power adapter cable is inaccessible to customers of the retail store. The other end of the power adapter cable 38 is electrically connected to a power input port 60 provided on the article of merchandise M. The power input port 60 may be a standard female micro-USB jack for receiving a corresponding standard male micro-USB plug 39 of the power adapter cable 38. However, the power input port 60 and the connector 39 on the end of the power adapter cable 38 may be any suitable type of connector interface. Regardless, the alarm unit 30 is configured to activate an alarm disposed within the alarm unit in the event that the lanyard 40 is severed or removed (unplugged) from the power supply cable 50, and/or in the event that the power adapter cable 38 is severed or removed (unplugged) from the merchandise M.

According to one embodiment, electronics are disposed within the merchandise display security device 10, 30 that monitor whether an article of merchandise M is attached to the merchandise display security device. More particularly, the electronics monitor whether the article of merchandise M remains attached to the merchandise display security device 10, 30 once the article of merchandise has been secured and the merchandise display security device has been armed. In one embodiment, the attachment side 14, 34 is relatively planar and includes a proximity switch, limit switch, pressure switch or the like. A relatively planar rear surface of the article of merchandise M is securely attached to the attachment side 14, 34, for example by a relatively thin layer of an adhesive 33, such as double-sided pressure sensitive adhesive (PSA), in a known manner. Regardless, the switch may be configured to engage the rear surface of the article of merchandise M and may be electrically connected to the electronics disposed in the merchandise display security device 10, 30 either directly, or alternatively, through an electrical circuit disposed within the merchandise display security device. The status of the switch may change between an un-activated, or "non-alarming," state when the article of merchandise M is securely attached to the merchandise display security device and an activated, or "alarming," state when the article of merchandise is separated from the merchandise display security device.

In some embodiments, the merchandise display security device 10, 30 comprises an internal power source, and/or is electrically connected to an external power source. In either case, the power adapter cable 18, 38 is electrically connected to the power source to provide power to the article of merchandise M through the connector 19, 39 of the power adapter cable that is electrically connected to the power input port provided on the article of merchandise. As will be readily appreciated by those skilled in the art, the opposite end of the power adapter cable 19, 39 is electrically connected to the merchandise display security device 10, 30. As a result, the power adapter cable 19, 39 both mechanically and electrically connects the article of merchandise M to the merchandise display security device 10, 30.

The lanyard 40 may comprise a plurality of conductors. At least some of the conductors of the lanyard 40 may be electrically connected at one end to the electronics disposed within the merchandise display security device 30, and are electrically connected at the other end to the power supply cable 50. At least some of the other conductors of the lanyard 40 may be electrically connected at one end to an internal power source within the merchandise display security device 30, or alternatively, to an external power source, and electrically connected at the other end to the power output port 37. Moreover, the power adapter cable 38 may contain at least a pair of conductors that are electrically connected to a corresponding pair of conductors of the lanyard 40. The conductors of the power adapter cable 38 are electrically connected to the article of merchandise M through the connector 39 at an end of the power adapter cable. As such, the power adapter cable 38 functions to provide electrical power from the internal or external power source to the article of merchandise M.

As such, the merchandise display security device 10, 30 is positioned inline between the OEM power supply cable and the article of merchandise. The connection of the OEM power supply cable, alarm unit, and power adaptor cable provides an electrical connection that is detectable by the alarm unit, such as by providing a sense loop therethrough. For example, the merchandise display security device may be configured to activate an alarm when the connector 19, 39 of the power adaptor cable 18, 38 is removed from the article of merchandise, or the opposite end of the power adaptor cable is removed from the alarm unit. In addition, the merchandise display security device 10 may be configured to alarm when the OEM power supply cable 20 is removed from the alarm unit. Similarly, the alarm unit may be configured to activate an alarm in the event that the connector 42 coupled to the lanyard is removed from the OEM power supply cable at one end or removed from the alarm unit at an opposite end. Moreover, the alarm unit may be configured to activate an alarm in response to cutting of the power adaptor cable 19, 39 and/or the lanyard 40.

The foregoing has described one or more embodiments of a merchandise display security device for displaying and protecting an article of merchandise Embodiments of a merchandise display security device have been shown and described herein for purposes of illustrating and enabling the best mode of the invention. Those of ordinary skill in the art, however, will readily understand and appreciate that numerous variations and modifications of the invention may be made without departing from the spirit and scope of the invention. Accordingly, all such variations and modifications are intended to be encompassed by the appended claims.

That which is claimed is:

1. A merchandise display security device for an article of merchandise comprising:

an alarm unit;

a first connector electrically coupled to the alarm unit and configured to releasably engage the article of merchandise; and a second connector electrically coupled to the alarm unit, the second connector configured to releasably engage an original equipment manufacturer power supply cable such that the alarm unit is disposed between a source of electric power and the article of merchandise, and the original equipment manufacturer power supply cable is configured to provide power to both the alarm unit and the article of merchandise, and wherein the alarm unit is configured to activate an alarm in the event that the first connector is removed from the article of merchandise and activate an alarm in the event that the second connector is removed from the original equipment manufacturer power supply cable.

2. The merchandise display security device according to claim 1, wherein the second connector is configured to releasably engage the original equipment manufacturer power supply cable.

3. The merchandise display security device according to claim 1, wherein the alarm unit comprises a body having an attachment side configured for attachment to the article of merchandise, the attachment side having a recess defined therein.

4. The merchandise display security device according to claim 3, wherein the second connector is inaccessible when the attachment side of the body is attached to the article of merchandise.

5. The merchandise display security device according to claim 3, wherein the second connector is disposed within the recess.

6. The merchandise display security device according to claim 3, wherein the recess is adapted to receive a portion of the original equipment manufacturer power supply cable therein.

7. The merchandise display security device according to claim 1, wherein each of the first connector and the second connector is a micro-USB connector.

8. The merchandise display security device according to claim 1, wherein the first connector is electrically coupled to a power adaptor cable at a first end thereof, and wherein a second end of the power adaptor cable is electrically coupled to the alarm unit.

9. The merchandise display security device according to claim 1, further comprising a lanyard electrically coupled to the alarm unit at a first end, and wherein the second connector is disposed at a second end of the lanyard.

10. The merchandise display security device of claim 9, wherein the lanyard is configured to releasably engage the original equipment manufacturer power supply cable at a location inaccessible to a customer.

11. The merchandise display security device according to claim 1, wherein the first and second connectors are the same type.

12. A method for securing an article of merchandise from theft, the method comprising:

providing an alarm unit comprising a first connector and a second connector each electrically coupled to the alarm unit;

coupling the article of merchandise to the first connector; and coupling the second connector to an original equipment manufacturer power supply cable such that the alarm unit is disposed between a source of electric power and the article of merchandise, and the original equipment manufacturer power supply cable is configured to provide power to both the alarm unit and the article of merchandise, wherein the alarm unit is configured to activate an alarm in the event that the first connector is removed from the article of merchandise and activate an alarm in the event that the second connector is removed from the original equipment manufacturer power supply cable.

13. The method according to claim 12, wherein coupling the second connector comprises releasably attaching the second connector to the original equipment manufacturer power supply cable.

14. The method according to claim 12, wherein the first connector is electrically coupled to a power adaptor cable at a first end thereof, and wherein coupling the first connector comprises coupling the power adapter cable to the article of merchandise via the first connector so as to couple the alarm unit to the article of merchandise.

15. The method according to claim 12, further comprising releasably engaging a lanyard to the original equipment manufacturer power supply cable via the second connector.

16. The method according to claim 15, wherein releasably engaging comprises releasably engaging the original equipment manufacturer power supply cable to the lanyard at a location inaccessible to a customer.

17. The method according to claim 12, further comprising attaching the article of merchandise to the alarm unit such that the second connector is inaccessible to a customer.

18. A merchandise display security device for an article of merchandise comprising:

an alarm unit configured to be attached to an article of merchandise;

a first connector electrically coupled to the alarm unit and configured to releasably engage the article of merchandise; and a second connector electrically coupled to the alarm unit, the second connector configured to releasably engage an original equipment manufacturer power supply cable such that the alarm unit is disposed between a source of electric power and the article of merchandise, and the original equipment manufacturer power supply cable is configured to provide power to both the alarm unit and the article of merchandise, and wherein the alarm unit is configured to activate an alarm in the event that the second connector is removed from the original equipment manufacturer power supply cable.

19. The merchandise display security device of claim 18, wherein the second connector is disposed on the alarm unit or disposed on an end of a lanyard attached to the alarm unit.

* * * * *